United States Patent [19]

Watanabe et al.

[11] 4,401,462

[45] Aug. 30, 1983

[54] PROCESS FOR PRODUCING METALLIC MAGNETIC POWDER

[75] Inventors: Akio Watanabe; Tosiaki Ide; Tatsuo Uehori, all of Tokyo, Japan

[73] Assignee: TDK Electronics Co., Ltd., Tokyo, Japan

[21] Appl. No.: 250,042

[22] Filed: Apr. 1, 1981

[30] Foreign Application Priority Data

Apr. 1, 1980 [JP] Japan ..... 55/43288

[51] Int. Cl.[3] ..... C22C 1/04

[52] U.S. Cl. ..... 75/0.5 BA; 75/0.5 AA; 148/105

[58] Field of Search ..... 75/0.5 BA, 0.5 AA; 148/105

[56] References Cited

U.S. PATENT DOCUMENTS

| | | | |
|---|---|---|---|
| 4,274,865 | 6/1981 | Suzuki et al. | 75/0.5 BA |
| 4,290,799 | 9/1981 | Schroeder et al. | 75/0.5 B |
| 4,342,589 | 8/1982 | Ohshima et al. | 75/0.5 BA |

*Primary Examiner*—John P. Sheehan

*Attorney, Agent, or Firm*—Oblon, Fisher, Spivak, McClelland & Maier

[57] ABSTRACT

A metallic magnetic powder as fine metallic particles is produced by adsorbing zinc ion on iron oxyhydroxide in a alkaline bath with heating during or after the adsorption and then reducing it.

12 Claims, 1 Drawing Figure

PROCESS FOR PRODUCING METALLIC MAGNETIC POWDER

BACKGROUND OF THE INVENTION

1. Field of the Invention:

The present invention relates to a process for producing a metallic magnetic powder by adsorbing zinc ion $Zn^{2+}$ on iron oxyhydroxide and then reducing it in hydrogen gas atmosphere etc. to form fine metallic powder.

2. Description of Prior Arts:

Heretofore, acicular iron oxide has been mainly employed as a magnetic powder for magnetic recording media.

In view of the recent development and widespread use of magnetic recording apparatus such as home VTR and high functional audio cassettes, it has been required to attain high density recording of signal for a magnetic recording medium. It has been difficult to attain such requirement for high density magnetic recording only by using the acicular iron oxide. It has been required to obtain a magnetic powder having higher coercive force and higher magnetic flux density. Recently, fine metallic powders have been studied as magnetic powders having such required magnetic characteristics. In view of increase of utility of the magnetic powder for short wavelength recording, a fine metallic powder having further superior magnetic characteristics has been needed.

It has been known to produce a fine metallic powder by reducing iron oxyhydroxide at 350° to 500° C. in hydrogen gas flow as one process.

Various processes have been proposed to improve the magnetic characteristics, for example, a formation of iron oxyhydroxide having superior squareness, an addition of a third component such as Co, Ni, Sn and Al in the production of iron oxyhydroxide, an adsorption of the third component on iron oxyhydroxide, or an adsorption of a sintering inhibitor on iron oxyhydroxide.

SUMMARY OF THE INVENTION

It is an object of the present invention to provide a process for producing a fine metallic powder having superior magnetic characteristics by adsorbing zinc ion $Zn^{2+}$ as a third component on iron oxyhydroxide with an activation of a surface of iron oxyhydroxide and an inhibition of a precipitation of $Zn(OH)_2$.

The foregoing and other objects of the present invention have been attained by producing fine metallic powder by adsorbing zinc ion an iron oxyhydroxide and reducing it wherein said zinc ion is adsorbed on said iron oxyhydroxide in an alkaline bath with heating during or after the adsorption.

DETAILED DESCRIPTION OF THE PREFERRED EMBODIMENTS

Figure 1:
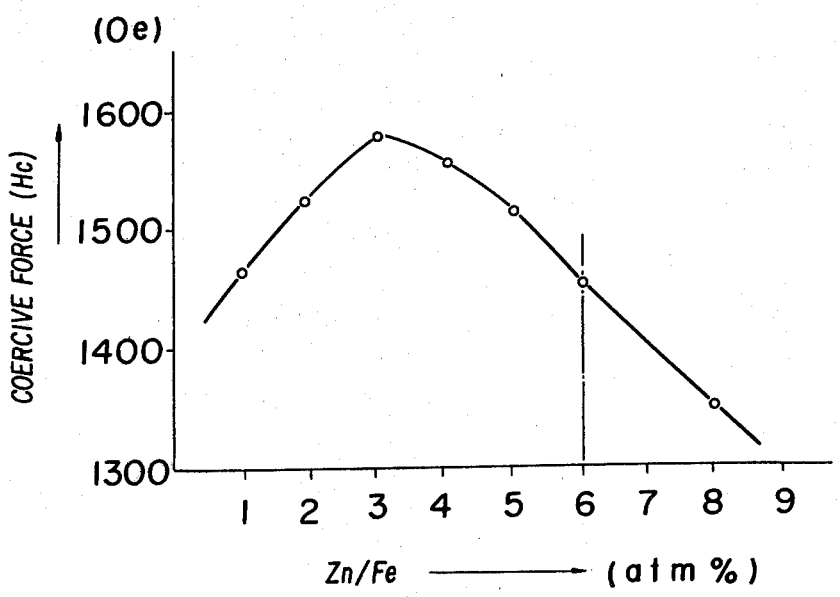
FIG. 1 is a graph showing the relation of contents of Zn and coercive forces.

In the process of the present invention, iron oxyhydroxide can be the conventional iron oxyhydroxide used for producing metallic magnetic powders and zinc ion can be given as a zinc salt such as zinc chloride or sulfate if necessary in an acidic condition with a mineral acid such as hydrochloric acid and sulfuric acid. The iron oxyhydroxide and the zinc ion are known in the conventional processes.

When zinc ion $Zn^{2+}$ is adsorbed on iron oxyhydroxide by using $ZnCl_2$, $ZnSO_4$ etc. among the third components such as Co, Ni, Zn, Sn and Al, the surface of fine acicular iron oxyhydroxide is modified whereby a reducing velocity in the reduction for forming fine metallic particles become slow and sintering of the fine particles can be prevented and the magnetic characteristics of the fine metallic particles obtained by the reduction are improved.

A content of zinc ion $Zn^{2+}$ is preferably in a range of 1 to 6 atm.% based on Fe of the iron oxyhydroxide.

In accordance with the present invention, the alkaline bath having high concentration is used for adsorbing zinc ion $Zn^{2+}$ on the iron oxyhydroxide. The surface of the iron oxyhydroxide is activated and the precipitation of $Zn(OH)_2$ is prevented by the adsorption in the alkaline bath whereby the adsorption of zinc ion $Zn^{2+}$ on the iron oxyhydroxide is promoted to improve the effect of the adsorption of zinc ion and the magnetic characteristics of the fine metallic particles obtained by the reduction are improved.

It has been found that the adsorption of zinc ion $Zn^{2+}$ on the iron oxyhydroxide is further promoted by heating the alkaline bath having high concentration at a temperature ranging from 70° to 100° C.

The concentration of the base is preferably greater than 1 normal especially greater than 3 normal such as 10 normal. The heating is preferably in boiling.

The concentrations of the iron oxyhydroxide and the zinc ion can be those of the conventional processes.

The present invention will be further illustrated by certain examples and references which are provided for purposes of illustration only and are not intended to be limiting the present invention.

REFERENCE 1

In a reduction furnace, 0.5 g. of acicular iron oxyhydroxide having a minor axis of 0.02 μm and an acicular ratio of 15:1 was reduced at 450° C. in hydrogen gas flow at a rate of 1.5 liter/min. for 90 minutes. The resulting fine metallic powder had a coercive force Hc of 1390 Oe.

EXAMPLE 1

Into 300 ml. of water, 10 g. of the iron oxyhydroxide used in Reference 1 was dispersed and then, 200 ml. of 10 N-NaOH aqueous solution was added to it with thoroughly stirring and then each amount of 0.1-N $ZnCl_2$ aqueous solution (acidified with a dilute sulfuric acid) was added with stirring. Then, the mixture was heated at 85° C. for about 1 hour and filtered and washed to obtain a wet cake of iron oxyhydroxide. The wet cake was dried at about 70° C. for 16–24 hours and pulverized.

In accordance with the process of Reference 1, 0.5 g. of the resulting pulverized powder was reduced. The relation of the contents of Zn and the coercive forces of the fine metallic powders is shown in FIG. 1.

REFERENCE 2

In accordance with the process of Reference 1 except using 0.5 g. of acicular iron oxyhydroxide having a minor axis of 0.5 μm and an acicular ratio of about 8:1, the acicular iron oxyhydroxide was reduced to obtain a fine metallic powder. The resulting fine metallic powder had a coercive force Hc of 810 Oe.

EXAMPLE 2

Into 300 ml. of water, 10 g. of iron oxyhydroxide used in Reference 2 was dispersed and then, 200 ml. of 10 N-NaOH aqueous solution was added to it with thoroughly stirring and then 44.8 ml. of 0.1-N $ZnCl_2$ aqueous solution was added with stirring. Then, the mixture was heated at 85° C. for about 1 hour and filtered and washed to obtain a wet cake of iron oxyhydroxide. The wet cake was dried at about 70° C. for 16–24 hours and pulverized.

In accordance with the process of Example 1, the resulting powder was reduced to obtain a fine metallic powder. The resulting fine metallic powder had a coercive force Hc of 1045 Oe.

REFERENCE 3

In accordance with the process of Reference 1 except using 0.5 g. of acicular iron oxyhydroxide having a minor axis of 0.2 μm and an acicular ratio of about 30:1, the acicular iron oxyhydroxide was reduced to obtain a fine metallic powder. The resulting fine metallic powder had a coercive force Hc of 1650 Oe.

EXAMPLE 3

In accordance with the process of Example 1 except that the acicular iron oxyhydroxide used in Reference 3 was used and 0.1-N $ZnCl_2$ aqueous solution was added to give a content of Zn of 2 atm.% based on Fe of the iron oxyhydroxide, a fine metallic powder was produced. The resulting fine metallic powder had a coercive force Hc of 1715 Oe.

REFERENCE 4

Into 500 ml. of water, 10 g. of the acicular oxyhydroxide used in Reference 1 was dispersed and then, 33.7 mg. of 0.1-N $ZnCl_2$ aqueous solution was added to it with stirring for 1 hour as set forth in Example 1. The mixture was filtered and washed.

In accordance with the process of Example 1, the product was treated and reduced to obtain a fine metallic powder. The resulting fine metallic powder had a coercive force Hc of 1470 Oe.

REFERENCE 5

In comparison with Example 1, 0.1-N $ZnCl_2$ aqueous solution was added to give a content of Zn of 3 atm.% based on Fe of iron oxyhydroxide and conditions were controlled to obtain acicular iron oxyhydroxide having a minor axis of 0.02 μm and an acicular ratio of about 15:1.

In accordance with the Reference 1, 0.5 g. of the resulting pulverized dry iron oxyhydroxide was reduced in an electric furnace. The resulting fine metallic powder had a coercive force Hc of 1510 Oe.

As it is clearly found in the comparison of the data of Examples 1 to 3 with References 1 to 3, even though the same acicular iron oxyhydroxide is used, the products of Examples 1 to 3 were excellent fine metallic powders having high coercive forces which are higher for the maximum of 235 Oe than the fine metallic powders obtained by the reduction of the untreated acicular iron oxyhydroxide in the hydrogen gas flow as References 1 to 3.

In comparison of Example 1 with References 4 and 5, it was found that the product of Example 1 was excellent fine metallic powder having high coercive force which is higher for the maximum of 100 Oe than the product of References 4 and 5.

In accordance with the process for using an alkaline bath and heating the alkaline bath in the step of adsorbing zinc ion $Zn^{2+}$ on iron oxyhydroxide, excellent fine metallic powder having superior magnetic characteristics can be obtained.

Even though the alkaline bath is used and heated in the absorption of zinc ion $Zn^{2+}$ on iron oxyhydroxide, a coercive force of the resulting fine metallic powder is varied depending upon a content of Zn based on Fe of iron oxyhydroxide as shown in FIG. 1. The fine metallic powders having higher coercive force can be obtained at a content of Zn of 1 to 6 atm.% based on Fe of iron oxyhydroxide.

As described above, in accordance with the process of the present invention, an alkaline bath is used for adsorbing zinc ion and the mixture is heated in the process for producing fine metallic powder by adsorbing zinc ion ($Zn^{2+}$) on iron hydroxide and reducing the product, whereby the surface of iron oxyhydroxide is activated and the precipitation of $Zn(OH)_2$ is inhibited to promote the deposition of zinc ion $Zn^{2+}$ on iron oxyhydroxide and the sintering of the particles in the reduction is prevented to produce excellent metallic magnetic powder having superior magnetic characteristics. The metallic magnetic powder having especially superior magnetic characteristics can be obtained at a content of Zn of 1 to 6 atm.% based on Fe of iron oxyhydroxide.

We claim:

1. A method of producing a finely divided, metallic magnetic powder, comprising:
   adsorbing zinc ions on iron oxyhydroxide in an alkaline bath of a base concentration greater than 1 N and simultaneously heating the mixture; and
   subsequently reducing the iron oxyhydroxide having zinc ions adsorbed thereon.

2. A method of producing a finely divided, metallic magnetic powder, comprising:
   adsorbing zinc ions on iron oxyhydroxide in an alkaline bath of a base concentration greater than 1 N and thereafter heating the mixture; and
   reducing the iron oxyhydroxide having zinc ions adsorbed thereon.

3. The process of claim 1, wherein the content of adsorbed zinc ions range up to 6 atm% based on the amount of iron in said iron oxyhydroxide.

4. The process of claim 2, wherein the content of adsorbed zinc ions ranges up to 6 atm% based on the amount of iron in said iron oxyhydroxide.

5. The process of claim 1, wherein said alkaline bath is heated to a temperature ranging from 70° to 100° C.

6. The process of claim 2, wherein said alkaline bath is heated to a temperature ranging from 70° to 100° C.

7. The process of claim 1, wherein said alkaline bath is an aqueous solution of an alkali metal hydroxide or carbonate.

8. The process of claim 2, wherein said alkaline bath is an aqueous solution of an alkali metal hydroxide or carbonate.

9. The process of claim 1, wherein the concentration of base ranges from 3 N to 10 N.

10. The process of claim 2, wherein the concentration of base ranges from 3 N to 10 N.

11. The process of claim 1, wherein the source of adsorbed zinc ions is zinc chloride or zinc sulfate.

12. The process of claim 2, wherein the source of adsorbed zinc ions is zinc chloride or zinc sulfate.

* * * * *